United States Patent [19]

Sakai et al.

[11] Patent Number: 4,780,644

[45] Date of Patent: Oct. 25, 1988

[54] GAS DISCHARGE DISPLAY PANEL

[75] Inventors: Tetsuo Sakai; Hiroshi Murakami; Seiji Sega, all of Tokyo, Japan

[73] Assignee: Nippon Hoso Kyokai, Tokyo, Japan

[21] Appl. No.: 57,749

[22] Filed: Jun. 3, 1987

Related U.S. Application Data

[63] Continuation of Ser. No. 694,762, Jan. 25, 1985, abandoned.

[51] Int. Cl.[4] ..... G09G 3/22; H01J 65/22

[52] U.S. Cl. ..... 313/582; 313/485; 313/619; 313/584; 315/169.4; 315/84.61; 340/772; 340/771

[58] Field of Search ..... 315/169.3, 169.4, 84.61; 313/584, 586, 582, 587, 619, 485, 491, 492; 340/771, 753, 769, 805, 772

[56] References Cited

U.S. PATENT DOCUMENTS

| | | | |
|---|---|---|---|
| 3,739,218 | 6/1973 | Maloney | 315/169.4 X |
| 3,743,879 | 7/1973 | Kupsky | 315/169.4 X |
| 4,206,386 | 6/1980 | Akutsu et al. | 315/169.4 |
| 4,392,075 | 7/1983 | Kamegaya et al. | 313/584 |
| 4,516,053 | 5/1985 | Amano | 313/584 |
| 4,566,006 | 1/1986 | Okamoto et al. | 315/169.4 |

FOREIGN PATENT DOCUMENTS

| | | | |
|---|---|---|---|
| 53-65657 | 6/1978 | Japan | 315/169.4 |
| 54-158859 | 12/1979 | Japan | 313/584 |
| 55-66832 | 5/1980 | Japan | 313/582 |

OTHER PUBLICATIONS

Okamoto et al., "A New DC Gas-Discharge Panel with Internal Memory for Color Television Display", IEEE Trans. on Electron Devices, vol. ED-25, No. 1, Jan. 1978.

*Primary Examiner*—David K. Moore
*Assistant Examiner*—Mark R. Powell
*Attorney, Agent, or Firm*—Parkhurst, Oliff & Berridge

[57] ABSTRACT

A gas-discharge memory-type display panel having distinctively high radiation efficiency is realized by plural negative glow type discharge cells operating with a discharge electrode distance normalized filled gas pressure product ($d \cdot p_o$) being in the range of 0.5 to 8.0 Torr·cm, at an average discharge current of less than 50 μA. Improved radiation efficiency can be further raised by direct viewing of radiation from fluorescent layers arranged flat on a rear plate of a simplified two-plate structure of a sealed envelope which can be readily manufactured.

7 Claims, 8 Drawing Sheets

GAS DISCHARGE DISPLAY PANEL

This is a Continuation of application Ser. No. 694,762, filed Jan. 25, 1985, now abandoned.

BACKGROUND OF THE INVENTION (1) Field of the Invention:

The present invention relates to a gas-discharge display panel for displaying a color picture, comprising plural gas-discharge cells arranged in a matrix, respective discharge spaces which are enclosed by a transparent front plate and a rear plate and respective fluorescent layers which are deposited on an inner surface of those plates. More particularly, the invention relates to the improvement effected by raising radiation efficiency and simplifying and facilitating manufacture of the display panel.

The present invention further relates to a high definition type gas-discharge display panel comprising plural gas cells which are simply constructed such that large plate size and high radiation efficiency are facilitated.

(2) Description of the Background Art:

Conventional direct current type gas-discharge display panels of various kinds, including one memory type, have an advantage such that high radiation efficiency, for instance on the order of approximately 0.3%, can be attained by utilizing a positive column generated by a gas discharge. At the same time, the radiation time duration can be elongated by providing a memory function or the like, so as to further increase the brightness of a displayed picture. However, in these prior displays the discharge path is required to be elongated so as to generate the positive column. The display must therefore be provided with a cell sheet for keeping inner surfaces of the front and the rear plates away from each other so as to elongate the discharge path thereof. Further, these displays require using a production technique for depositing fluorescent material, which is customarily called "phosphor", on an inner surface of an elongated hole provided through the cell sheet as the discharge space of the cell. Consequently, the gas-discharge cell of this kind has various disadvantages including difficulty of manufacture resulting in lack of mass-producibility and the expensive production.

Another kind of gas-discharge cell utilizing negative glow has been substantially deserted for displaying a color picture because of low radiation efficiency on the order of 0.02%, and further has a serious defect of lack of practical usability because of the unstable gas discharge being driven by a small discharge current.

Meanwhile, high definition type gas-discharge display panels of various kinds are under development to attain large size, high efficiency and further high definition. Among these display panels, a two-plate type gas-discharge panel formed, roughly speaking, of a transparent front insulation plate and a rear insulation plate has been adapted as the most suitable for the above mentioned development.

FIGS. 1*a* and 1*b* show a typical conventional structure of the gas-discharge display panel of this two-plate type. FIG. 1(*a*) is a cross-section showing a portion thereof and FIG. 1(*b*) is a plan view from the viewer side of the panel as shown in FIG. 1(*a*).

The conventional panel as shown in FIGS. 1(*a*) and (*b*) is formed of two plates comprising a transparent front glass plate FG and a rear insulation plate RG. An inner surface of the front glass plate FG is formed with plural triangular elongated grooves in parallel with one another. A display anode DA is disposed on a bottom of each of these grooves, while a shading layer LS is disposed on each of the flat portions of these grooves. On every other one of the grooves, a scanning anode SA operating as an auxiliary anode to be described later is disposed. In addition, fluorescent layers Ph of red (R), green (G) and blue (B) respectively are disposed separately on inclined side-walls of these grooves. Plural elongated cathodes DC are disposed in parallel on an inner surface of the rear insulation plate RG formed, for instance, of glass.

This conventional gas-discharge display panel of the two-plate type is operated such that the fluorescent layers Ph disposed on the inclined walls of the grooves formed in the inner side of the transparent front plate FG are brightened under the excitation of ultra-violet rays emitted from the gas-discharge generated between the display anode DA and the cathode DC. Hence, the brightened fluorescent layers Ph are viewed through the transparent front plate FG by a viewer. The scanning of this gas-discharge display panel is effected by priming discharges successively generated between the plural scanning anodes SA and the plural cathode DC. A voltage or a current is applied in response to an amplitude of a picture signal to be displayed between the cathode DC and the display anode DA positioned in the vicinity of the generated priming discharge, so as to emit the aforesaid exciting ultra-violet rays.

However, this conventional gas-discharge display panel of two-plate type has the serious defect of contamination of displayed colors due to the inferior segregation between discharge cells.

FIG. 2 shows another conventional structure of a gas-discharge display panel of three-plate type.

This conventional structure is of three-plate type comprises a cell sheet CS inserted between the front plate FG (not shown) and the rear plate RG. The cell sheet CS is provided with plural cylindrical cell holes therethrough, on inner walls of which fluorescent layers Ph in red (R), green (G) and blue (B) are applied in required cyclic order. The elongated display anode DA and the elongated cathode DC are disposed on the inner surfaces of the rear plate RG and the front plate FG respectively and cross each other at positions corresponding to the cylindrical cell holes. The elongated auxiliary scanning anode SA is disposed at bottoms of elongated recesses formed in the cell sheet CS in parallel with and midway between rows of cell holes.

This conventional display panel has superior segregation between discharge cells and high radiation efficiency because of the non-transmission type of view and because of the positive utilization of the positive column presenting excellent radiation efficiency of ultraviolet rays. However, this conventional display panel has production difficulty in application of fluorescent layers on the inner walls of the narrow cylindrical cell holes, which results in reduced possibility of industrial mass-production.

SUMMARY OF THE INVENTION

An object of the present invention is to provide a gas-discharge display panel in which the above mentioned defects are obviated and the negative glow, which has conventionally been regarded as practically unusable for displaying a colored picture, is employed. Another object of the invention is to provide a gas-discharge display panel which can be readily manufactured with simplified structure and which can be stably operated with small discharge current and with high radiation efficiency.

Yet another object of the present invention is to provide a gas-discharge display panel which can be of a large size by employing an extremely simplified discharge cell structure with a high radiation efficiency.

For attaining the above objects, a gas-discharge display panel according to the present invention comprises gas-discharge cells formed of a negative glow cell having a product $p_o \cdot d$, of a distance d between a display anode and a cathode and a normalized pressure $p_o$ of a gas filled in the gas-discharge cell, in a range between 0.5 and 8.0 Torr·cm, and having an area of the cathode not exceeding 15% of the total area of an inner wall of the gas-discharge cell. The cell of the present invention also exhibits an average discharge current during any continuous time duration of 50μsec not exceeding 50μA.

BRIEF DESCRIPTION OF THE DRAWINGS

For a better understanding of the invention, reference is made to the accompanying drawings, in which.

Throughout FIGS. 1–12, FG is a front glass plate, RG is a rear glass plate, DA is a display anode, SA is a scanning auxiliary anode, CR is a cathode conductor, PH is a priming hole, Ph is a fluorescent layer, CS, CS1 and CS2 are cell sheets, DC is a cathode, DCB is a cathode bus, d is a discharge distance, IG is an insulation glass film, IR is an insulation material, DAB is a display anode bus, SL is a slit and LS is a shading layer.

DESCRIPTION OF THE PREFERRED EMBODIMENTS

The present invention will be explained in detail regarding embodiments thereof by referring to the accompanying drawings hereinafter.

First, a novel negative glow cell, on which the present invention is based, will be described.

Figure 1A:
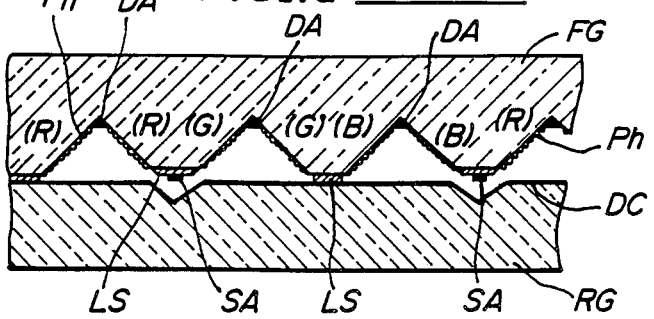
FIG. 1a PRIOR ART
FIGS. 1(*a*) and 1(*b*) are a cross-sectional view and a plan view respectively showing a part of a conventional gas-discharge display panel.
Figure 1B:
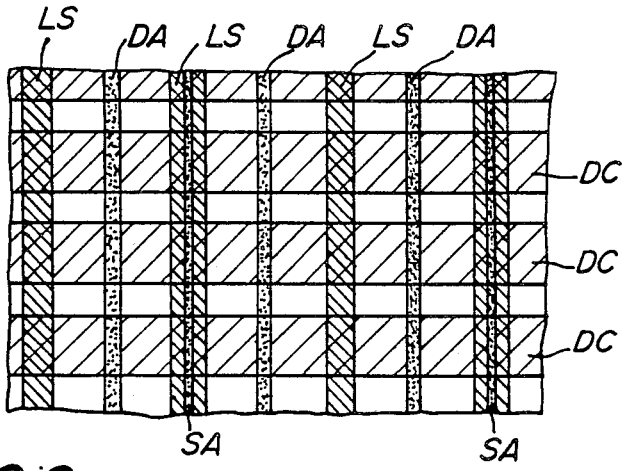
FIG. 1b PRIOR ART
Figure 2:
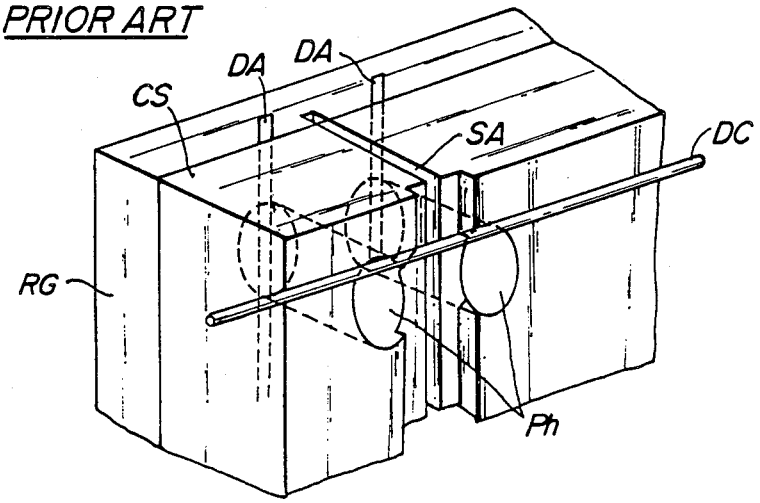
FIG. 2 PRIOR ART
FIG. 2 is a perspective view showing a part of another conventional gas-discharge display panel.
Figure 3A:
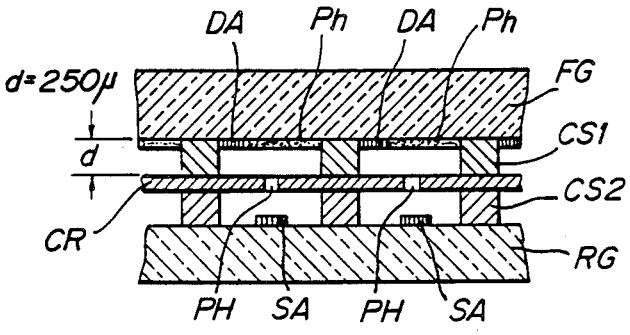
FIG.3a PRIOR ART
FIGS. 3(*a*) and 3(*b*) are a cross-sectional view and a characteristic curve, respectively, showing the structure and radiation performance of a conventional negative glow gas-discharge display panel.
Figure 3B:
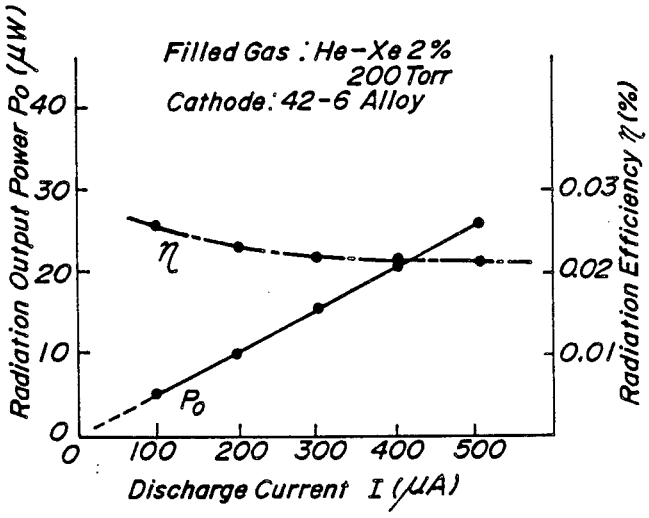
FIG.3b PRIOR ART

A gas-discharge cell in which a negative glow generated by the gas discharge is employed for radiation, in other words, a negative glow cell, is typically constructed as shown in FIG. 3(*a*). Regarding output and radiation efficiency thereof, it has been conventionally considered that the output of radiation is proportional to the amount of discharge current, while the radiation efficiency is substantially constant in spite of the variation of the amount of discharge current as shown in FIG. 3*b*. In this regard, it has been proposed for the negative glow cell employing $Zn_2SiO_4$:Mn as the green fluorescent material, that the radiation efficiency is somewhat raised in the region of minute discharge current on the basis of the saturation performance of the fluorescent material.

However, in the region of minute discharge current less than 50 μA, the gas discharge becomes unstable, so that the behavior thereof has heretofore been unknown. For clarifying the operational performance of the negative glow cell in this region of minute discharge current, the present inventors have precisely measured the operational performance of the negative glow cell which is intended to be stabilized by reducing the area of the cathode as described in the Japanese Utility Model Application Publication No. 8,130/1981. As a result, the present inventors have discovered the existence of another operation mode of the negative glow cell such that the radiation efficiency thereof is abruptly increased below a borderline of about 50μA of the discharge current, quite different from that conventionally expected.

Figure 4A:
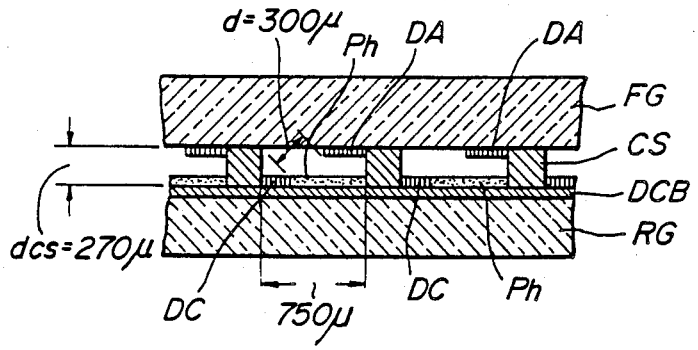
FIGS. 4(*a*) and 4(*b*) are a cross-sectional view and a characteristic curve, respectively, showing the basic structure and radiation performance of a negative glow type gas-discharge display panel according to the present invention.
Figure 4B:
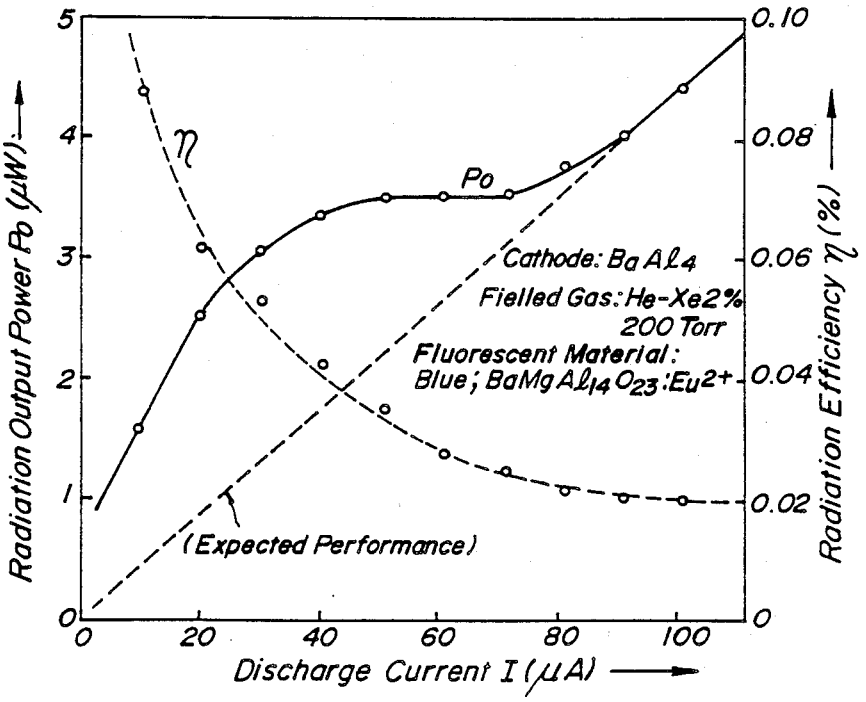

The structure of the negative glow cell adopted to accomplish the objects of the invention effected by the inventors is shown in FIG. 4(*a*) and the behavior thereof is shown by the characteristic curves as indicated in FIG. 4(*b*). As is apparent from the comparison between FIG. 4(*a*) and FIG. 3(*a*), the structure of the negative glow cell of the present invention is similar to the displaying portion of the conventional negative glow cell, and includes a plurality of discharge cells arranged in a matrix between a front glass plate FG and a rear glass plate RG spaced from each other by a cell sheet CS. In each discharge cell, a display anode DA is disposed on an inner surface of the front glass plate FG, while a display cathode DC and cathode bus DCB are disposed on an inner surface of the rear glass plate RG. A fluorescent layer Ph is disposed over bus DCB. In the glow cell of FIG. 4*a*, the material of the cathode consists of $BaAl_4$, and the filled gas consists of He-Xe 2% at 200 Torr. However, it has been discovered that the operational performance is substantially independent of the material of the cathode and the filled gas as described below in detail. Furthermore, when the negative glow cell is driven in the pulse discharge operation, the same tendency is maintained, so long as the average discharge current is kept at the aforesaid minute amount. With respect to the operational performance of the negative glow cell according to the present invention, as shown in FIG. 4(*b*), the efficiency n of radiation, defined as the ratio between the radiation output power $p_o$ and the discharge current I, under a constantly applied discharge voltage of, for instance, about 210 is rapidly raised in response to the performance of radiation output power $p_o$, which is largely different from the proportional line expected from the conventional performance as shown in FIG. 3(*b*), in the region where the average discharge current is much smaller than that of the conventional negative glow cell as shown in FIG. 3(*b*), particularly in the region where the average discharge current is less then 50 μA.

Figure 5A:
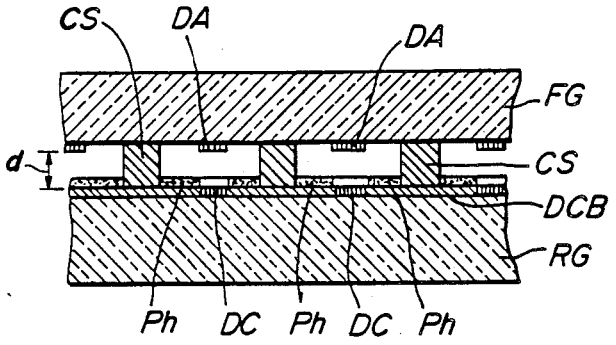
FIGS. 5(*a*) and 5(*b*) are a cross-sectional view and a plan view, respectively, showing an embodiment of the gas-discharge display panel according to the present invention.
Figure 5B:
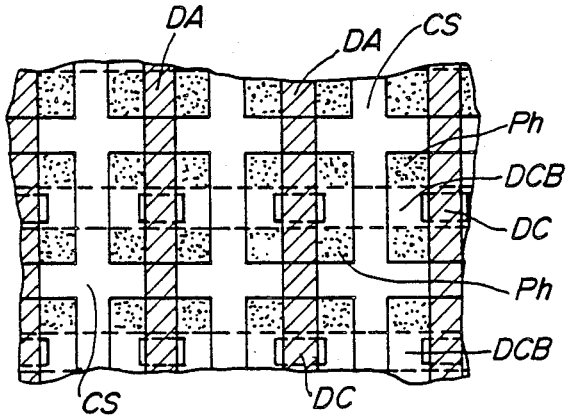

FIGS. 5(*a*) and 5(*b*) show the basic structure of the gas-discharge display panel according to the present invention based on the above described novel discovery relating to the efficiency of radiation of the negative glow cell. Referring to FIGS. 5*a* and 5*b*, each of the rectangular discharge cells are individually separated from one another by a parallel criss-cross shaped cell sheet CS inserted between a front glass plate FG and a rear glass plate RG. The discharge gas is filled at a uniform pressure in all of the discharge cells through minute gaps formed in the cell sheet CS. In each of the discharge cells, the discharge cathode DC, disposed on the inner surface of the rear glass plate RG, is covered by an insulation film employed for stabilizing the gas discharge, together with a cathode bus DCB except for the opening portion thereof. This insulation film can be substituted for by a fluorescent layer Ph similarly disposed on the inner surface of the rear glass sheet RG. However, as this insulation film is formed of a thick glass film, stabilization of the gas discharge can be insured. In this regard, the fluorescent layer Ph is applied on this insulation film and the cathode bus DCB by a printing technique or the like. This exemplary structure of the gas-discharge display panel is of the reflexive view type, so that the fluorescent layer Ph can be applied with a sufficient thickness. Conductor pieces of various electrodes such as the cathode DC, the cathode bus DCB and the display anode DA disposed on the inner surface of the front glass plate FG can be readily applied by a well-known manufacturing technique such as thick film printing.

In the gas-discharge display panel constructed as illustrated in FIGS. 5*a* and 5*b* and described above according to the present invention, the discharge distance d defined by a distance between the discharge anode DA and the discharge cathode DC, and the type and the pressure P of the filled gas are subject to the following restrictions for generating negative glow in the gas discharge.

First, when a rare gas is used as the most important of the filled gases for emitting ultraviolet rays, the filling gas pressure $P_o$ normalized on the basis of experiments is defined by the following equation (1).

$$P_o=\max\{0.8P_{He},1.5P_{Ne},2P_{Ar},6P_{Kr},9P_{Xe}\} \quad (1)$$

where: $P_{He}$, $P_{Ne}$, $P_{Ar}$, $P_{Kr}$, $P_{Xe}$ are partial pressures of filled gases He, Ne, Ar, Kr, Xe respectively.

The product $P_o \cdot d$ between the normalized gas pressure $P_o$ and the discharge distance d in the conventional gas-discharge display panel employing a positive column for radiation is defined by the equation:

$$12 \leqq P_o \cdot d \text{ Torr·cm}$$

while the same in the negative glow cell according to the present invention is defined by the equation:

$$0.5 \leqq P_o \cdot d \leqq 8 \text{ Torr·cm}$$

Specifically, the product $P_o \cdot d$ in the situation as shown in FIGS. 4(*a*) and 4(*b*) is about 4.8 Torr·cm. In the gas-discharge display panel employing a cathode formed of a metal belonging to a group of Ni, generally, mercury Hg is additionally filled in the discharge space for obviating the sputtering of the cathode. However, the partial pressure of this additionally filled mercury vapor is minute and hence is neglected in the present case.

Furthermore, the discharge current in the negative glow cell formed as according to the present invention is restricted to less than 50 μA. In addition, the exposed area of the cathode DC of the same negative glow cell, which is reduced for stabilizing the gas discharge as described earlier, is restricted not to exceed 15% of the total area of the inner wall surface of the cell.

In this regard, when the same negative glow cell is not provided with an inner wall surface of the cell sheet CS which is inserted for individually separating cells from each other, the above mentioned total area of the inner wall surface should be obtained on a condition assuming that an inner wall is disposed between each cell.

In the exemplary structure as shown in FIGS. 5(*a*) and 5(*b*), although the display anode DA is disposed on the inner surface of the front glass plate FG, the display anode DA is preferably moved onto the inner surface of the rear glass plate RG, while the cathode DC is disposed on the inner surface of the front glass sheet FG depending on the kind of material used in the cathode DC. For instance, when a material having a small work function such as $BaAl_4$ constitutes the cathode DC, the radiation efficiency can be raised almost 1.5 times by this interchange of electrodes. Further, in this situation, it is also required that only the opening portion provided on the cathode DC is exposed, while the remaining metallic portions of the cathode DC are covered by transparent insulation films.

Figure 6:
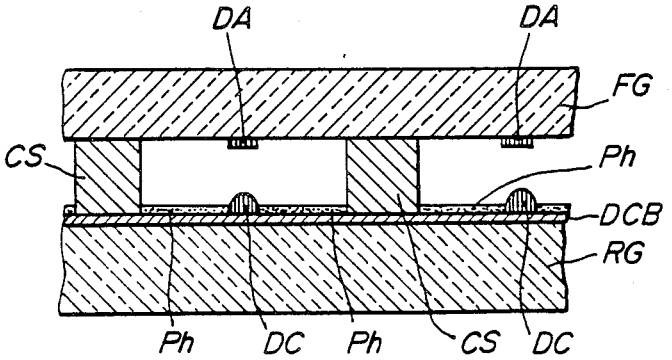
FIG. 6 is a cross-sectional view showing another embodiment of the present invention.

FIG. 6 shows another example of structure of the negative glow cell according to the present invention. In this example, the radiation efficiency can be raised approximately by 20% on account of the projection of the cathode DC from the surface of the fluorescent layer Ph attained by piling up the relevant portion of the cathode bus DCB. In addition, when at least a small portion of the projected cathode DC comprises material having a small work function, the negative glow cell can be operated at a low voltage, so that the radiation efficiency can be further raised.

Next, various embodiments of the present invention which are obtained by applying the invention to various kinds of memory type gas-discharge display panels will be explained.

As is apparent from the radiation performance of the negative glow cell as shown in FIG. 4(*b*), the negative glow cell according to the present invention has an excellent radiation efficiency. However, the radiation output power is not so large, so that sufficient brightness of the displayed picture can be obtained only by elongating the time duration of luminescence. Accordingly, the gas-discharge display panel of the present invention is required to be formed as a memory type.

Several examples of various kinds of memory type gas-discharge display panels in which high radiation efficiency is attained by employing a negative glow cell according to the present invention in response to the above requirement will be described hereinafter.

(1-a) A memory type gas-discharge display panel using resistive elements:

An example of this kind of memory type gas-discharge display panel using the present invention is shown in FIGS. 7(*a*) and 7(*b*). In the exemplary structure as shown in these drawings, the display anode bus DAB is connected to the display anodes DA of individual discharge cells through respective resistive elements R. These resistive elements R, and portions of the display anode bus DAB which are exposed in the discharge cells, are covered with transparent insulation material IG, for instance, glass materials. In addition, the resistance of the resistive element R is preferably in the range from 100 KΩ to tens of MΩ.

In this regard, the identical effect can be obtained by individually inserting this resistive element R between the cathode bus DCB and the cathodes DC on the inner surface of the rear glass plate RG, and further by operating the electrodes disposed on the inner surface of the front glass plate FG as shown in these drawings as the cathodes DC also.

(1-b) A pulse memory operation gas-discharge display panel:

When the display anode DA in the gas-discharge display panel as shown in FIGS. 5(*a*) and 5(*b*) is applied with a repeated pulse train, so-called pulse memory operation can be achieved, as is readily comprehended. In this situation, it is required to set the signal waveform of the applied driving pulse train such that the average discharge current does not exceed 50 μA in any continuous time duration of 50 μs by means of selecting the repetition interval of the applied pulse train. Particularly, it is preferable for readily obtaining excellent radiation efficiency to select the product between the discharge current and the time duration of discharge in the pulse discharge so as not exceed 10 nC (nano Coulomb).

Figure 7A:
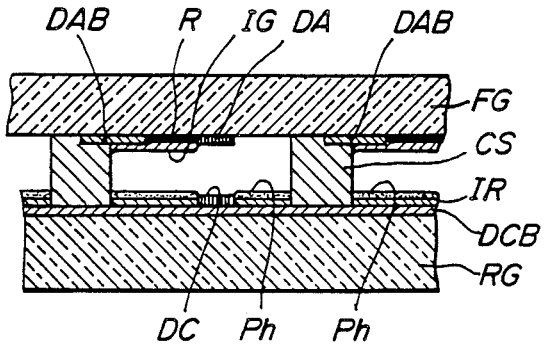
FIGS. 7(*a*) and 7(*b*) are a cross-sectional view and a plan view, respectively, showing still another embodiment of the present invention.
Figure 7B:
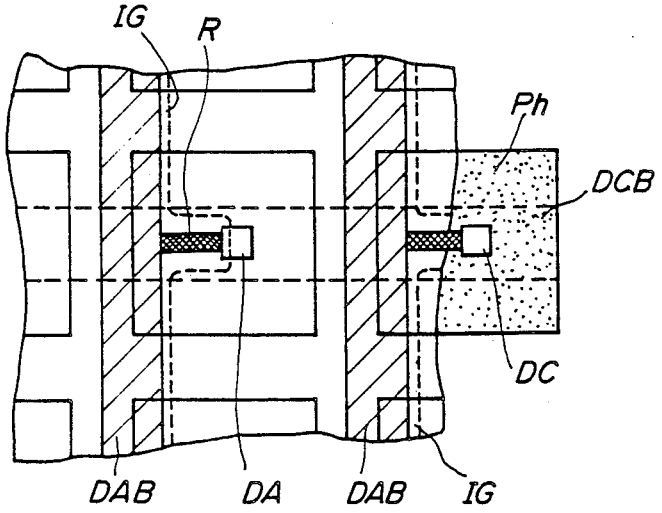

Under the above condition of operation, radiation efficiency, similar to that of a direct current gas discharge having a discharge current substantially identical to the average discharge current, can be obtained. In this regard, when the resistance of the resistive element R, employed in the exemplary structure as shown in FIGS. 7*a* and 7*b* is selected less than a few megaohms, the pulse memory operation under discharge current limit can be effected, as well as obviating the transition into arc discharge and the accompanying damage of discharge cells.

If a motion picture having halftone is to be displayed on the gas-discharge display panel by displaying pictures of 6–8 subfields during one field period, and scanning all of rows on the display panel during a short time (on the order of 2 msec), so as to drive all discharge cells in each of the rows to effect required gas-discharges, it is necessary also for the negative glow type gas-discharge display panel according to the present invention to be combined with negative glow cells having auxiliary scanning discharge cells. An example of the gas-discharge display panel according to the present invention which is composed of these combined discharge cells will be described hereinafter.

(2-a) A Burroughs type gas-discharge display panel:

A conventional negative glow cell composed as shown in FIG. 3(*a*) is known as a Burroughs type gas-discharge panel provided together with auxiliary scanning discharge cells. However, operation at small discharge current is unstable, so that the exposed area of the cathode DC must be restricted to less than 15% of the total area of the inner wall of the discharge cell. Accordingly, it is necessary to expose only the vicinity of priming hole and to cover the remaining portion with insulation materials including fluorescent material. The negative glow type gas-discharge display panel having the above structure presents comparatively high radiation efficiency in pulse memory type operation. In addition, when the resistive element is inserted between the display anode DA or the cathode DC and the respective bus, the radiation efficiency can be further raised in resistive memory type operation.

The gas-discharge display panel constructed as shown in FIG. 3(*a*) employs a ribbon-shaped cathode conductor CR sandwiched between the cell-sheets CS1 and CS2 as the lead conductor of the cathode DC. As a result, production troubles such as short circuiting of the ribbon-shaped cathode conductors CR are caused when reducing the cell pitch in order to obtain the high definition display panel.

Figure 8A:
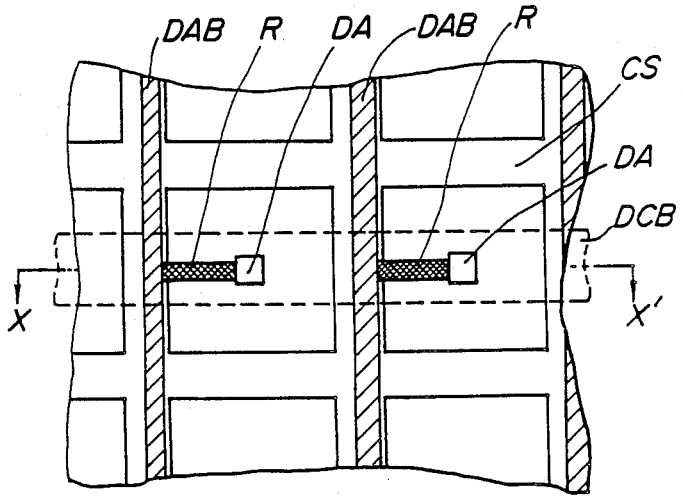
FIGS. 8(*a*) and 8(*b*) are a plan view and a cross-sectional view, respectively, showing yet another embodiment of the present invention.
Figure 8B:
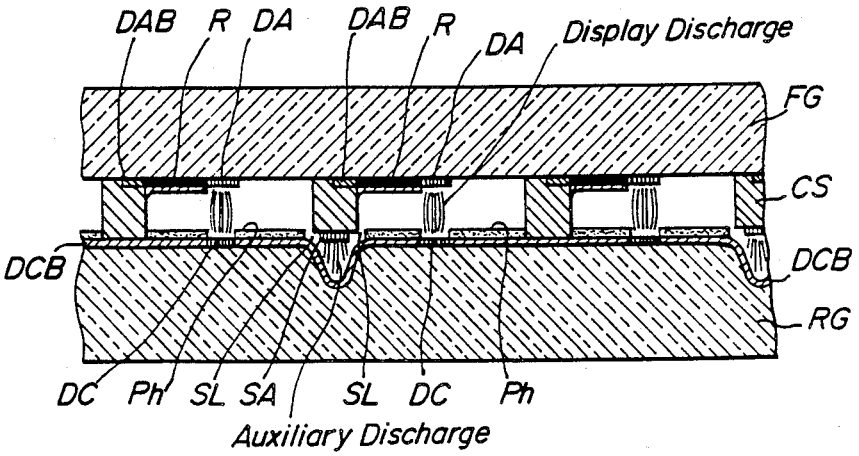

The gas-discharge display panel as shown in FIGS. 8(*a*) and 8(*b*) is constructed such that the above mentioned troubles can be obviated. That is, all of structural elements including the above mentioned cathode DC and cathode bus DCB, the display anode DA, the auxiliary scanning anode SA and the resistive element R are manufactured by thick-film printing or the combination of thick-film printing and thin-film deposition.

(2-b) A gas-discharge display panel provided with a scanning auxiliary discharge portion (Type I):

An embodiment as shown in FIGS. 8(*a*) and 8(*b*) is a fronted anode type in which the display anode DA is disposed on the inner surface of the front glass plate FG, as well as a resistive memory type in which the resistive element R is provided in series with the display anode DA. That is, a recess is formed on a portion of the inner surface of the rear glass plate RG, which portion is opposed to the bottom of the cell sheet CS which is provided on the inner surface of the front glass plate FG by thick-film printing so as to separate each cell. Further, a scanning auxiliary discharge cell is inserted between the auxiliary scanning anode SA disposed on the bottom of the cell sheet CS and the exposed portion of the curved cathode bus DCB disposed along the inner surface of the recess. In this regard, each column of auxiliary scanning anode SA is arranged in parallel between each group of two columns of display discharge on adjacent display discharge cells. The recess forms a groove on the inner surface of the rear glass plate RG, which groove is formed by etching, cutting, printing or the like in opposition to the auxiliary scanning anode SA. The cathode bus DCB is disposed across the recess and the conductor thereof is exposed as the cathode DC.

In this gas-discharge display panel, auxiliary discharge is generated in the vicinity of the cross point between the exposed portion of the cathode bus DCB in the recess and the auxiliary scanning anode SA. As a result, priming of display discharge is effected by dispersing into the display discharge cell through the slit SL provided between the cell sheet CS and the recess on the rear glass plate RG. Furthermore, the slit SL is operated as the path for introducing the filled gas into each cell.

The gas-discharge display panel composed as shown in FIGS. 8(*a*) and 8(*b*) can be operated also as a pulse memory type gas-discharge display panel by reducing the resistance of the inserted resistive element R, in a manner similar to the display panel composed as shown in FIGS. 7(*a*) and 7(*b*). In addition, it is possible to interchange the relation between each anodes DA, SA and the cathodes DC with similar operational conditions. It is also possible to dispose the resistive element R on the inner surface of the rear glass plate RG, so as to be inserted in series to the cathode DC.

Figure 9A:
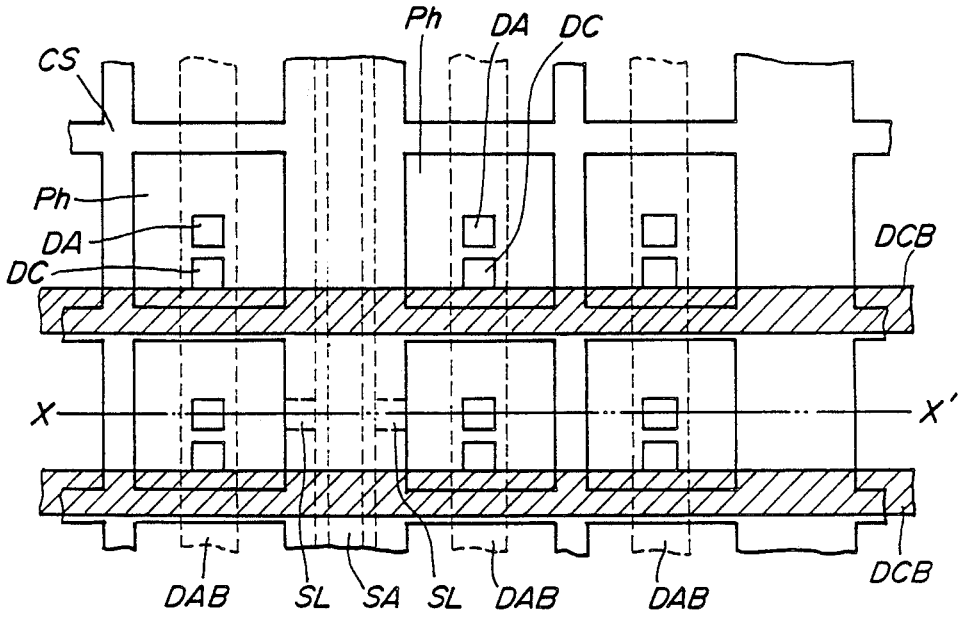
FIGS. 9(*a*) and 9(*b*) are a plan view and a cross-sectional view, respectively, showing still another embodiment of the present invention.
Figure 9B:
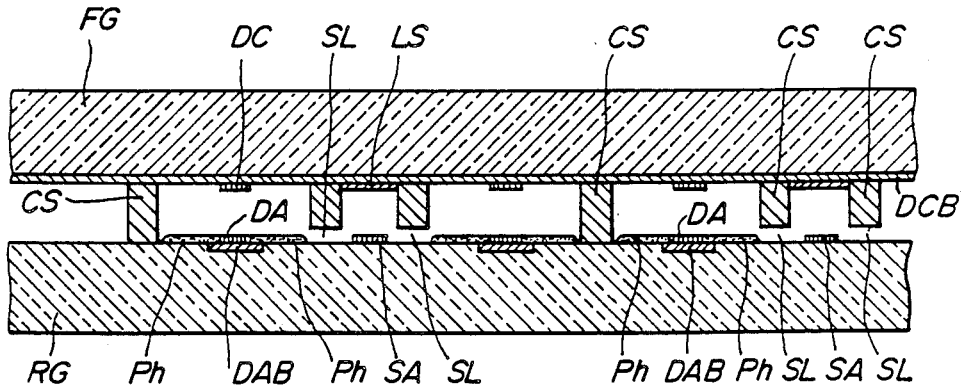

(2-c) A gas discharge panel provided with a scanning auxiliary discharge part (Type II):

Next, an example of a simplified structure provided for obtaining a high definition gas-discharge display panel according to the present invention will be described hereinafter, by referring to the plan view thereof as shown in FIG. 9(*a*) and the cross-sectional view as shown in FIG. 9(*b*).

In this structure of the gas-discharge display panel, the cathode DC and the cathode bus DCB are disposed on the inner surface of the front glass plate FG, while the display anode DA, the display anode bus DAB and the auxiliary scanning anode SA are disposed on the inner surface of the rear glass plate RG, the front and the rear glass plates constructing a gas-filled envelope together with the cell sheet CS sandwiched therebetween. In this gas-filled envelope, plural discharge cells are arranged in a matrix. In each of discharge cells, the inner surface of the rear glass plate RG is covered with fluorescent layers Ph except in the vicinity of the display anode DA. If it is feared that pinholes may exist in the fluorescent layers Ph, insulation layers are preferably laid under fluorescent layers Ph. Priming gas discharges individually generated between the auxiliary scanning anodes SA and the cathodes DC are introduced into display discharge cells through slits provided between the cell sheet CS and the rear glass plate RG. This exemplary gas-discharge display panel can be operated in the operational mode of line-at-a-time as well as in that of pulse memory.

As is apparent from FIG. 9(*a*), the lateral shift between the display anode DA and the cathode DC is favorable to the improvement of radiation efficiency. For obviating the generation of erroneous gas-discharges, the inner surface of the front glass plate FG, except in the vicinity of the cathode DC disposed therein, is preferably overcoated with insulation glass layers IG (not shown).

Figure 10:
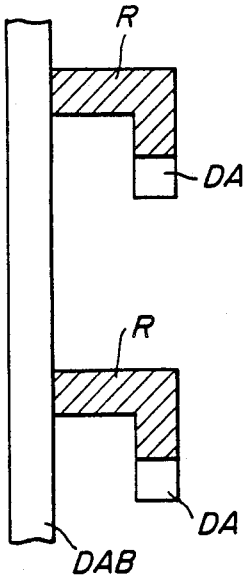
FIGS. 10 and 11 are diagrams respectively showing examples of a resistor inserted in series with a display anode and a cathode.
Figure 11:
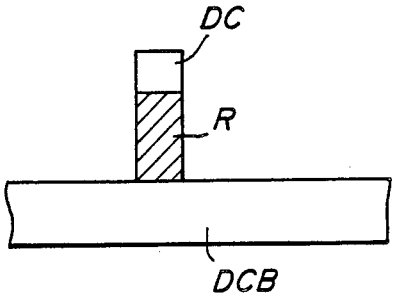

This exemplary display panel can be operated also as a resistive memory type display panel by individually inserting resistive elements R between the display anode bus DAB and each of the display anodes DA as shown in FIG. 10. The resistance of these resistive elements R is typically in a range from a few MΩ to tens of MΩ. However, when it is set less than a few MΩ, more efficient operation of the pulse memory type can be achieved. Particularly, when electron emitting materials, i.e., emitters, are employed for materials in cathode DC, the discharge current is favorably limited. In the gas-discharge display panel utilizing negative glow, higher radiation efficiency can be generally attained by a smaller discharge current, so that the above insertion of the resistive element R is effective in this regard also. Furthermore, it is a matter of course that the resistive element R can be similarly effectively inserted between the cathode bus DCB and the cathode DC, as shown in FIG. 11.

Next, the operation of this exemplary display panel will be described hereinafter.

Figure 12:
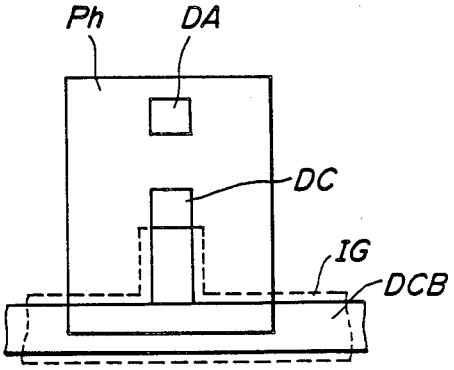
FIG. 12 is a diagram showing an example of the position of the cathode being the most suitable for a negative glow type gas-discharge cell according to the present invention.

The positions of the diplay anode DA and the cathode DC depend upon the amount of the aforesaid product $p_o \cdot d$, while this product $p_o \cdot d$ should be determined on the basis of the balance between the margin of memory function and the stability of gas-discharge as well as manufacturability. As for the above embodiments, it is most suitable for the negative glow type display panel that the cathode DC is disposed in the vicinity of the center of the display discharge cell, while the display anode DA is disposed at any corner thereof, as shown in FIG. 12. In this regard, it is significant for stability of gas-discharge to project the cathode DC and the display anode DA somewhat from the inner surface of the front or the rear glass plate FG or RG.

(3) Materials and manufacturing methods:

Next, structural materials, manufacturing methods and operational conditions employed in common for the above mentioned various examples of the negative glow type gas-discharge display panel according to the present invention will be successively described hereinafter.

(3-a) Electrode conductors and cathode materials:

(a) Cathode consisting substantially of Ni:

In this case, mercury Hg is introduced into the gas-filled envelope for facilitating the sputtering of electrode materials. Thus, the exposure of electrode materials causing amalgamation together with mercury Hg, such as Ag and Au, is avoided. The lead conductor of the discharge electrode which is formed of printed Ni thick film, cannot pass through the sealed wall of the gas-filled envelope. Therefore, this lead conductor is formed of silver Ag at the portion passing through the sealed wall. In the situation where the display panel is large, the resistance of the elongated cathode bus DCB becomes so large that the operation of the panel is deleteriously affected. Accordingly, in this situation, it is necessary to form the cathode bus DCB of conductor having very low resistivity such as Ag, Au, Cu, Al, etc. or alloys and mixtures thereof, while covering the portion thereof relevant to the cathode DC only with an overcoat Ig of glass. The electrode disposed within the panel may be formed of a base of Ag and other metals on which Ni is deposited.

Ni can be employed in the form of a ribbon of 42Ni-6Cr-52Fe alloy or the like. However, Ni is usually used in the form of a film which is deposited on a glass plate by thick-film printing, deposition, sputtering or plating, similar to other kinds of metal.

(b) Cathode consisting of metals other than Ni:

In this case, it is not required to use Hg in the filled gas, so that a desired metal can be employed in the panel. That is, desired metals such as Cu-Al, Cr-Cu-Cr, CuAl alloy and the like can be employed. Accordingly, so-called emitter materials can be used for the cathode. For the emitter, metals having a small work function such as $BaAl_4$, $BaAl_3O_4$, $LaB_6$, Ag+Mg, $BaLaO_4$, BaO and the combination or the mixture thereof have been employed hitherto. Also, for the deposition method, printing, deposition and sputtering as well as plating and plasma-injection can be adopted.

As mentioned earlier, when the cathode is formed of the aforesaid emitter materials and projected into the discharge space, gas-discharge can be stabilized even at small discharge current and hence high efficiency can be obtained.

(3-b) Insulation materials:

When using comparatively thin insulation films, transparent thick glass films are employed. It is a matter of course that these insulation films can be formed by customary manufacturing techniques such as deposition.

On the other hand, when thick insulation films are used, such as for partitions between discharge cells, namely, so-called banks, ribs, shims or cell-sheets, thin sheets of glass, light-sensitive glass, Macor and the like can be used and can be processed by etching or mechanical cutting as well as by printing and burning glass pastes for a super-thick film.

At the slit portion, the thickness of the cell sheet CS is reduced by tens of microns corresponding to the width of the slit.

For light shading, black glass, $RuO_2$ or a like black insulation material is deposited by methods similar to those mentioned above.

(3-c) Resistive elements:

For resistive elements used for gas-discharge cells, thick films of $RuO_2$ are usually employed. In addition, transparent conductors consisting of Ta, NiCr, $SnO_2$ and the like can be employed also.

(3-d) Fluorescent material and gases:

For fluorescent materials, $(Y, Gd)BO_3$:Eu and $YBO_3$:Eu are employed for red, $Zn_2SiO_4$:Mn and $BaAl_{12}O_{19}$:Mn are employed for green and $BaMgAl_{14}O_{28}$:$Eu^{2+}$ and $BaMg_2Al_{14}O_{24}$:$Eu^{2+}$ for blue, respectively. Application can be effected, for instance, by printing, spraying or applying together with lightsensitive adhesives. In this connection, for fluorescent layers Ph in the gas-discharge display panel according to the present invention, it is substantially sufficient to apply these layers Ph on flat portions within the discharge cells, that is, the inner surfaces of the front or the rear glass plate FG or RG. However, radiation efficiency can be further raised by applying these fluorescent layers Ph on side-walls of the discharge cells.

For the filled gas, a mixture of He-Xe is principally employed.

(3-e) Manufacturing methods:

For formation of patterns of various structural elements of the gas-discharge cells, photolithography is suitable as well as printing.

In addition, for manufacturing the resistive memory type gas-discharge display panel, the resistive elements R can be disposed on the inner surface of the rear glass plate RG, as well as on that of the front glass plate FG, so long as these elements R can be inserted in series to discharge electrodes provided in the discharge cells.

As is apparent from the above, according to the present invention, a gas-discharge display panel having remarkably high radiation efficiency can be realized on the basis of extremely small discharge current operation of a negative glow type discharge cell. In addition, a display panel having an efficiently high definition with a fine cell pitch can be readily manufactured by efficient viewing of radiation from the fluorescent layers arranged flat in each discharge cell.

In the situation where priming discharge for scanning is jointly applied, high speed addressing of discharge cells can be facilitated and hence display of a television picture can be suitably carried out.

Effects of the present invention are as follows:

(1) On account of the direct viewing of radiation from the fluorescent layers arranged flat on the rear glass plate of the display panel, the above improved radiation efficiency of the negative glow cell can be further raised by 1.3 to 3.0 times in comparison with conventional transmissive viewing of radiation through the fluorescent layer itself.

(2) Halftone display of a television picture can be achieved because of high speed addressing of discharge cells, based on the priming discharge for scanning.

(3) Large display panels can be readily realized because of the simple structure thereof.

What is claimed is:

1. A memory-type negative glow gas-discharge display panel comprising: a sealed envelope having at least two plates including a substantially transparent front plate and a rear plate, inner surfaces of which include display anodes and dislay cathodes disposed respectively together with a fluorescent layer, to form at least one discharge cell, a filled gas for emitting an ultraviolet ray wherein a product ($d \cdot p_o$) of a distance (d) between each said display anode and said display cathode and normalized pressure ($p_o$) of said filled gas is in a range between 0.5 and 8.0 Torr·cm, wherein an area of said display cathodes does not exceed 15% of a total area of inner walls of said at least one discharge cell, and wherein an average discharge current of said at least one discharge cell during an continuous interval of 50 μsec does not exceed 50 μA ;

whereby a highly efficient, stabalized negative glow discharge current is generated in said at least one discharge cell.

2. A memory-type negative glow gas-discharge display panel as claimed in claim 1 further comprising: resistive elements individually inserted between said display cathodes and buses connected thereto so as to effect resistor memory-type operation.

3. A memory-type negative glow gas-discharge display panel as claimed in claim 1 further comprising: scanning anodes for scanning said at least one discharge cell arranged on the inner surface of said rear plate, wherein said display cathodes are arranged on the inner surface of said front plate and said display anodes are arranged together with said scanning anodes on the inner surface of the rear plate.

4. A memory-type negative glow gas-discharge display panel as claimed in claim 3 further comprising a first plurality of buses connected to said display anodes, and a second plurality of buses connected to said display cathodes, said first and second plurality of buses being criss-crossed, each of said display cathodes being disposed in the vicinity of a central axis of a respective discharge cell.

5. A memory-type negative glow gas-discharge display panel as claimed in claim 4 wherein said display anodes and said display cathodes are disposed apart from each other in respective discharge cells to generate and sustain said highly efficient, stabalized negative glow discharge, fluorescent layers being disposed around each said display anode on the inner surface of said rear plate.

6. A memory-type negative glow gas-discharge display panel as claimed in claim 1 further comprising: resistive elements individually connected to said display anodes, and buses connected to said resistive elements so as to effect resistor memory-type operation.

7. A memory-type negative glow gas-discharge display panel as claimed in claim 1 further comprising: first plurality of resistive elements respectively connected to said display cathodes, a first plurality of buses connected to said first resistive elements, a second plurality of resistive elements respectively connected to said display anodes and a second plurality of buses connected to said ssecond resistive elements so as to effect resistor memory-type operation.

* * * * *